US006149022A

United States Patent [19]

Akyildiz et al.

[11] Patent Number: 6,149,022

[45] Date of Patent: Nov. 21, 2000

[54] BOTTLE AND CAP

[75] Inventors: Saban Akyildiz; Carmela Nitti Akyildiz, both of White Plains, N.Y.

[73] Assignee: Last Drop, Inc., White Plains, N.Y.

[21] Appl. No.: 09/320,373

[22] Filed: May 26, 1999

Related U.S. Application Data

[63] Continuation-in-part of application No. 09/026,909, Feb. 20, 1998, Pat. No. 5,947,622.

[51] Int. Cl.[7] ..... A46B 11/00; B65D 41/06

[52] U.S. Cl. ..... 215/222; 215/332; 215/342; 401/129

[58] Field of Search ..... 215/216, 222–225, 215/303, 316, 317, 318, 321, 342, 260, 262, 270, 307, 311, 315, 288; 220/231, 203.23, 203.25, 203.27, 203.29, 784, 786, 788, 297, 300, 303, 281; 401/126, 127, 129

[56] References Cited

U.S. PATENT DOCUMENTS

| | | | |
|---|---|---|---|
| 3,559,832 | 2/1971 | Balducci | 215/222 |
| 3,964,634 | 6/1976 | Jasinski et al. | 215/224 |
| 4,313,686 | 2/1982 | Proffer | 401/129 |
| 4,768,682 | 9/1988 | Friedrich | 215/222 |
| 5,116,154 | 5/1992 | Fulkerson | 401/129 |
| 5,161,706 | 11/1992 | Weinstein | 215/223 |
| 5,803,288 | 9/1998 | Munini | 215/342 |
| 5,947,622 | 9/1999 | Akyildiz et al. | 401/129 |

FOREIGN PATENT DOCUMENTS

| | | | |
|---|---|---|---|
| 19639558 | 4/1998 | Germany | 401/129 |
| 620649 | 12/1980 | Switzerland | 215/224 |

*Primary Examiner*—Nathan J. Newhouse
*Attorney, Agent, or Firm*—Gottlieb, Rackman & Reisman, P.C.

[57] ABSTRACT

A bottle having a container and a specially formed neck having a flange with downwardly sloping portion and which is spaced from the container to create a recess between the flange and the container. The bottle cap has an inner shell and an outer shell. A sealing surface moves longitudinally within the inner shell. The outer shell is preferably flexible and has prongs facing inwardly to move outwardly when the outer shell is compressed by a person's fingers. Other embodiments lack a separate inner shell and employ different operation of the prongs to retain the cap. In one case, rotation of the cap brings these prongs beneath a set of blind slots which engage the prongs and restrain their upward motion. Another embodiment allows the prongs to pass through slots to engage the underside of the flange. Further embodiments have a pressure release buttons built into the cap and a protective cap placed over the outer cap.

12 Claims, 5 Drawing Sheets

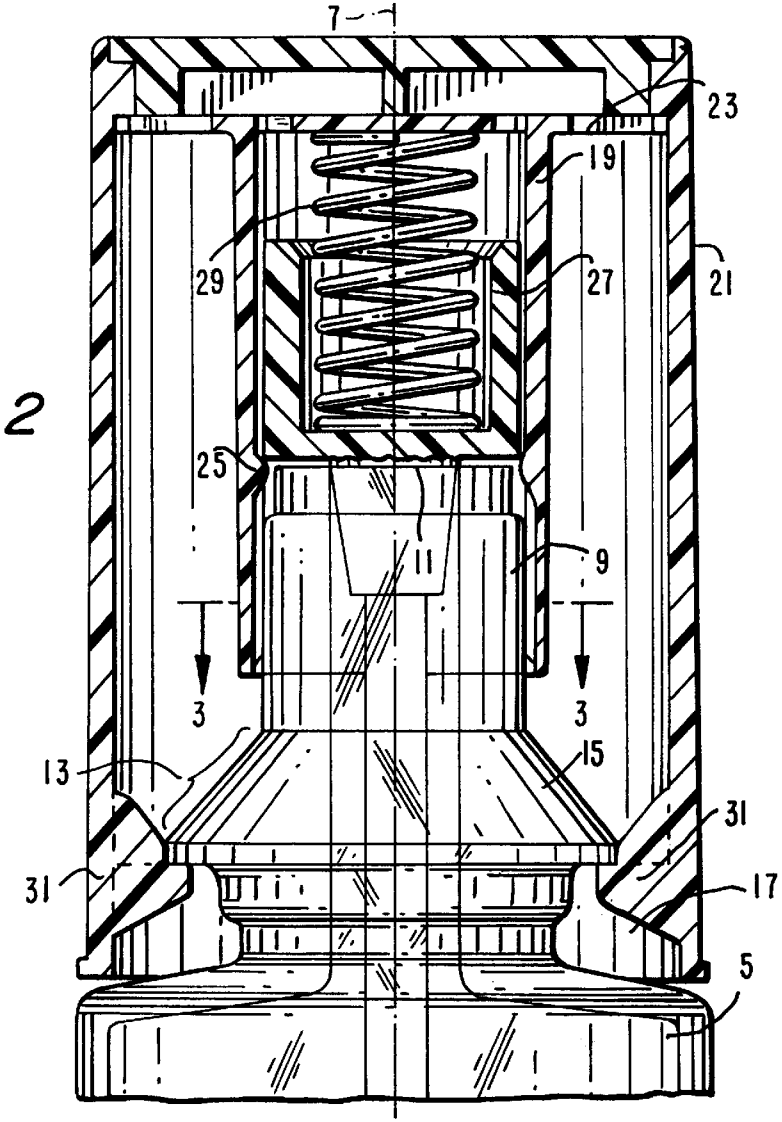
FIG. 2
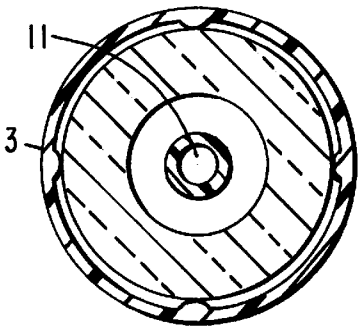
FIG. 3
FIG. 1
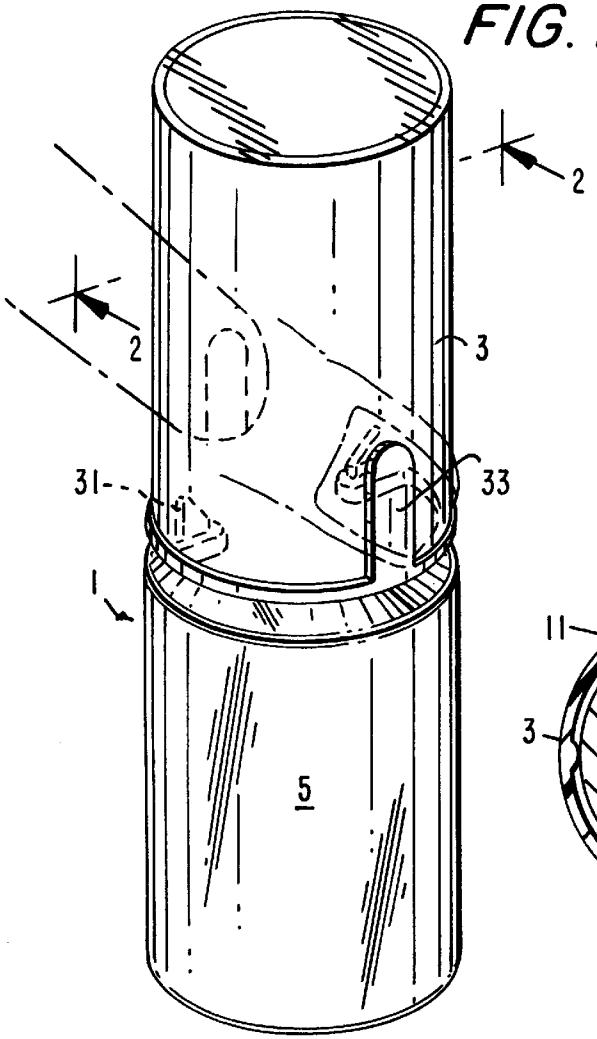

BOTTLE AND CAP

This application is a continuation-in-part of our prior application, Ser. No. 09/026,909, filed Feb. 20, 1998 now U.S. Pat. No. 5,947,622.

FIELD OF THE INVENTION

This invention relates to closure devices for containers. In particular it relates to quick release caps. In one application it is suitable for bottles containing volatile or pressurized liquids.

BACKGROUND OF THE INVENTION

Many configurations of bottles and caps are known. The difficulty with the design of such structures are that the need to have an effective seal to prevent the contents becoming stale, evaporating or degassing usually requires cumbersome locking mechanisms that make removal of the cap difficult. For example, bottles containing nail polish or glues may contain a brush built into the cap so that during use the cap is placed on and removed many times during a single application of the contents. An easily removable cap that effectively seals the contents of the bottle is clearly desirable.

Many attempts have been made to develop such caps. These have to overcome some specialized problems. The contents of the bottles may be spilled onto the closing mechanism and jam it. This is particularly true of screw closures. Screw closures also require many motions to close the cap.

With the advent of flexible plastic caps there have been attempts to design caps using prongs to engage a flange on an outer surface of a bottle. The use of such prongs permit quick release of the cap from the bottle. Also there have been caps that have contained pressure exerting internal components to seal an orifice leading to the bottle contents.

What has been lacking is an effective design incorporating each of these components to provide the quick release and effective sealing that would advance this technology.

BRIEF DESCRIPTION OF THE INVENTION

The present invention comprises in one embodiment a bottle having a container having a specially formed neck through which contents pass which is sealed by the cap. The neck has a flange with downwardly sloping portion and which is spaced from the container to create a recess between the flange and the container. The bottle cap has an inner shell and an outer shell. A sealing surface moves longitudinally within the inner shell. A spring maintains downward pressure on the sealing surface to close the orifice.

The outer shell is preferably flexible and has prongs facing inwardly to move outwardly when the outer shell is compressed by a person's fingers.

Other embodiments lack a separate inner shell and employ different operation of the prongs to retain the cap. In one case, rotation of the cap brings these prongs beneath a set of blind slots which engage the prongs and restrain their upward motion. Another embodiment allows the prongs to pass through slots to engage the underside of the flange.

Further embodiments have a pressure release buttons built into the cap and a protective cap placed over the outer cap.

DETAILED DESCRIPTION OF PREFERRED EMBODIMENTS

Figure 5:
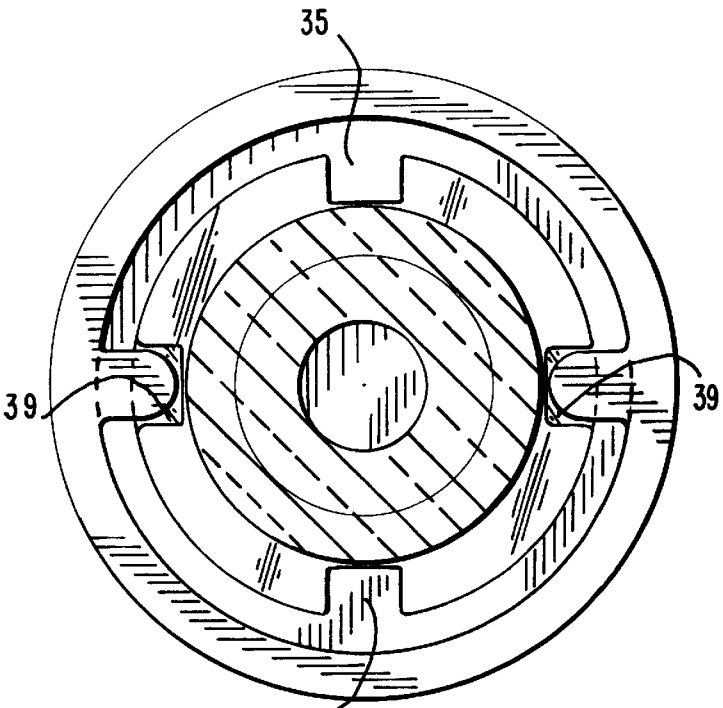

Various preferred embodiments of the bottle and cap of the present invention are depicted in the figures. FIG. 1 depicts a bottle 1 and a cap 3. The bottle has a container 5, which is the lower part of the bottle. The container has a longitudinal axis 7. A neck 9 extends upwardly from the container 5 and terminates in an orifice 11 through which contents pass when entering or leaving the bottle. Although the narrow neck is particularly suitable for a liquid, the bottle may be used for any products and the neck may be widened to accommodate pills or powders for example. It is this orifice that must be sealed to prevent evaporation or degradation of the bottle contents or escape of gases from the bottle.

The neck 9 has a flange 13 which extends horizontally (i.e. transverse to the longitudinal axis of the bottle). It has a downwardly sloping portion 15 which has an outer diameter less than the outer diameter of container. The flange is spaced longitudinally away from the container 5 so as to create a recess 17 between the flange and the container.

The bottle cap 3 has an inner shell and an outer shell 21 both extending downwardly from the top 23 of the cap. The inner shell has an inner dimension fitting closely with external surface of the neck 9. Stops may be constructed on the inner surface of the inner shell 19 to prevent it being jammed down on the neck 9. The fitting of the inner shell to the neck is not critical, which permits the more easy placement and removal of the cap on the bottle. There is a sealing surface 27 which moves longitudinally within the inner shell to seal the orifice 11. A resilient structure 29, shown as a spring in FIG. 2, maintains downward pressure on the sealing surface to close the orifice. The resilient structure also assists in the removal of the cap from the bottle.

The outer shell 21 of the cap 3 may be made of a flexible plastic. At least its lower portion is preferably flexible. This flexible portion (which may include the entire outer shell) has an inner diameter larger than the maximum outer diameter of the sloping portion 15 of the flange 13 to enable the outer shell to pass over the flange when the cap is placed on the bottle. The outer shell 21 has prongs 31 facing inwardly (i.e. towards the longitudinal axis 7 of the bottle). These prongs in conjunction with the flexible portion of the outer shell are adapted to move outwardly (i.e. away from the longitudinal axis 7 of the bottle) when the outer shell is compressed at pressure points 33 against which pressure may be exerted by a person's fingers. The outward motion of the prongs must be sufficient to clear the sloping portion 15 of the flange 13.

In use, the cap 3 is placed over the neck of the bottle and pressed downwardly along the longitudinal axis of the bottle. The sealing surface 27 contacts the edge of the neck defining the orifice 11 and immediately seals it. Further downward pressure compressed the resilient structure 29 until the stops 25 engage the edge of the orifice. During that motion, the prongs 31, which have a sloped lower surface, bear against the sloping sides 15 of the flange 13 and are forced away from the longitudinal axis of the bottle until the prongs pass over the edge of the flange 13 and are restored by the flexible portion of the outer shell to a position under the flange in the recess 17.

FIG. 3 shows the relative dimension of the inner and outer shells of the cap.

Figure 4:
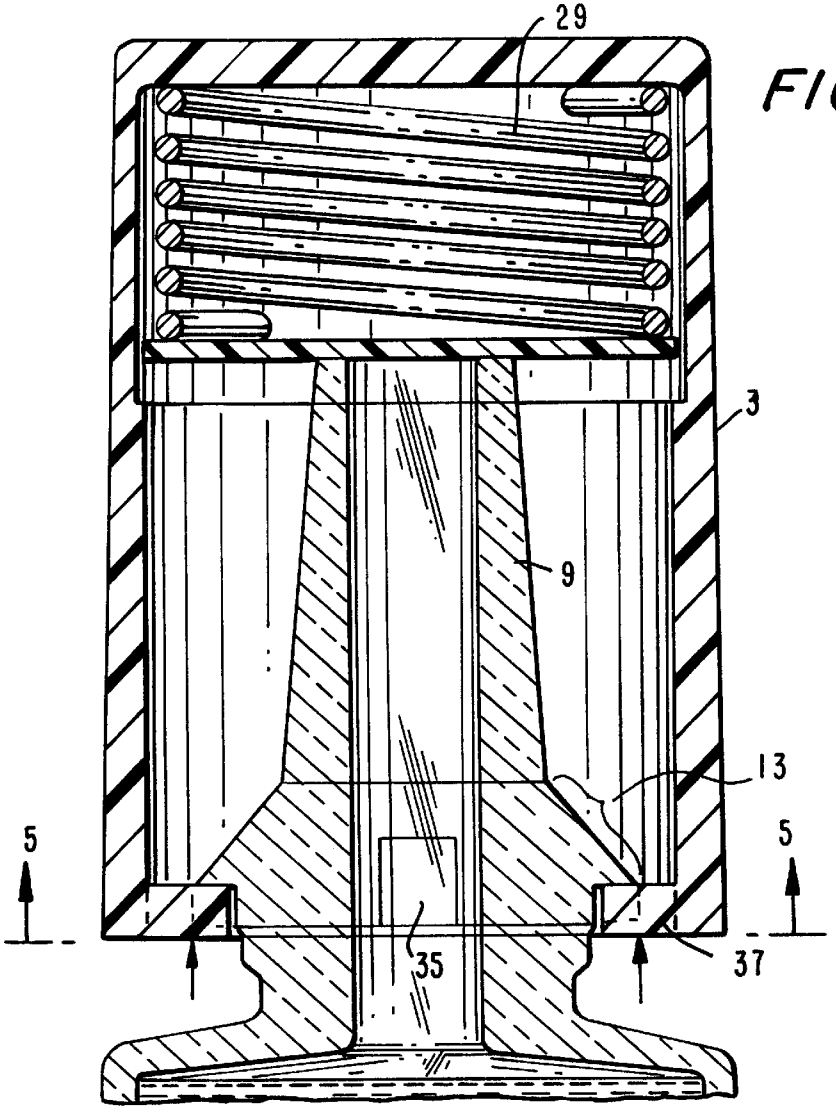

FIG. 4 shows and alternative embodiment of the invention, where corresponding numerals label parts having functions corresponding to those of the previous embodiment. The principal differences from the previous embodiment reside in the absence of a separate inner shell and the manner of operation of the prongs to retain the cap. Here the flange 13, as depicted in FIG. 5, has two different sets of slots. The first set 35 are designed to pass the prongs 37. Upon rotation of the cap these prongs are brought beneath a set of blind slots 39 which engage the prongs and restrain their upward motion under the force exerted by the resilient structure 29.

In operation, the embodiment of FIG. 4 is utilized by placing the cap over the neck and pressing downwardly until a seal is formed with the orifice and the prongs 37 pass through the slots 35. The cap is then rotated until the prongs reside below the blind slots 39 and the cap is released. For this embodiment it is not essential that the flange 13 have a sloping portion. If however a sloping portion is provided, then the rotation of the cap is not essential and the displacement of the prongs caused by contact with the sloped sides can be used to move the prongs so that they may engage the blind slots.

Figure 7:
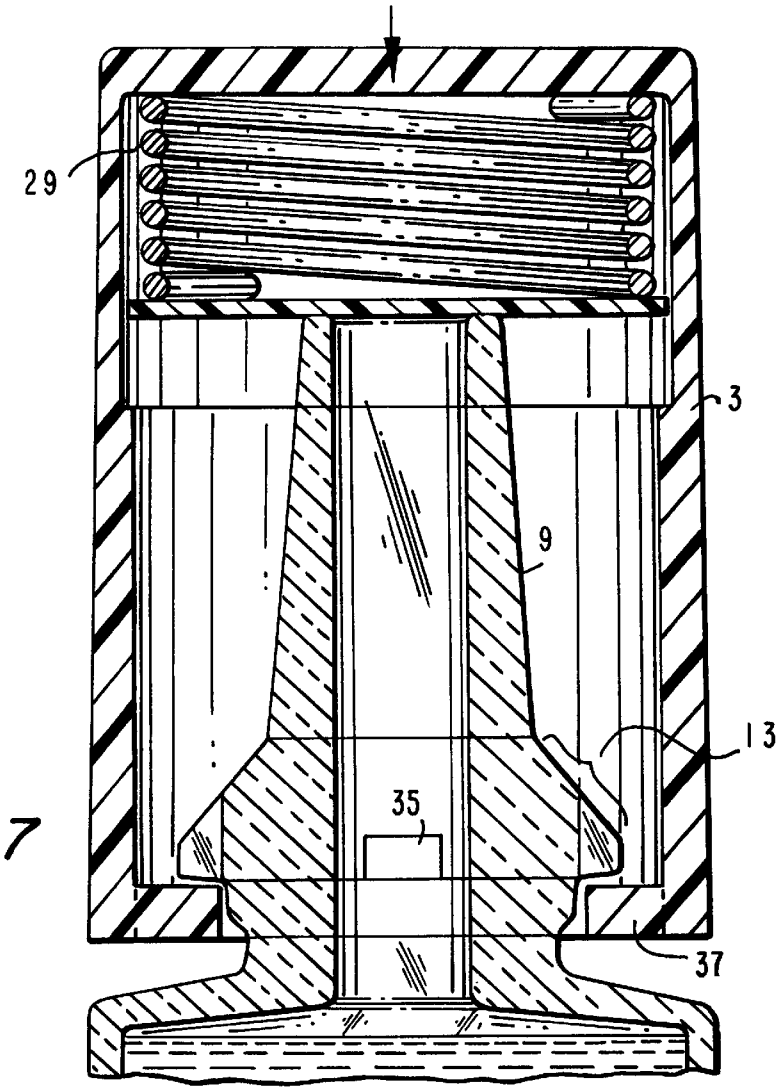
Figure 6:
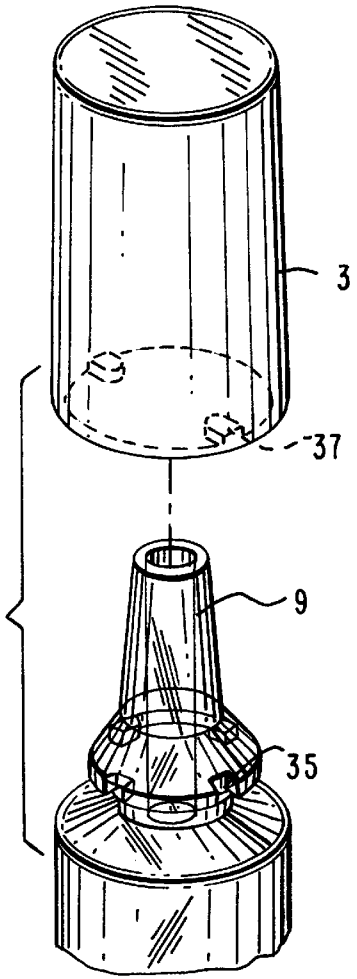

FIGS. 6 and 7 show a further embodiment in which there are not blind slots but in which the prongs pass through slots to engage the underside of the flange 13.

Figure 8:
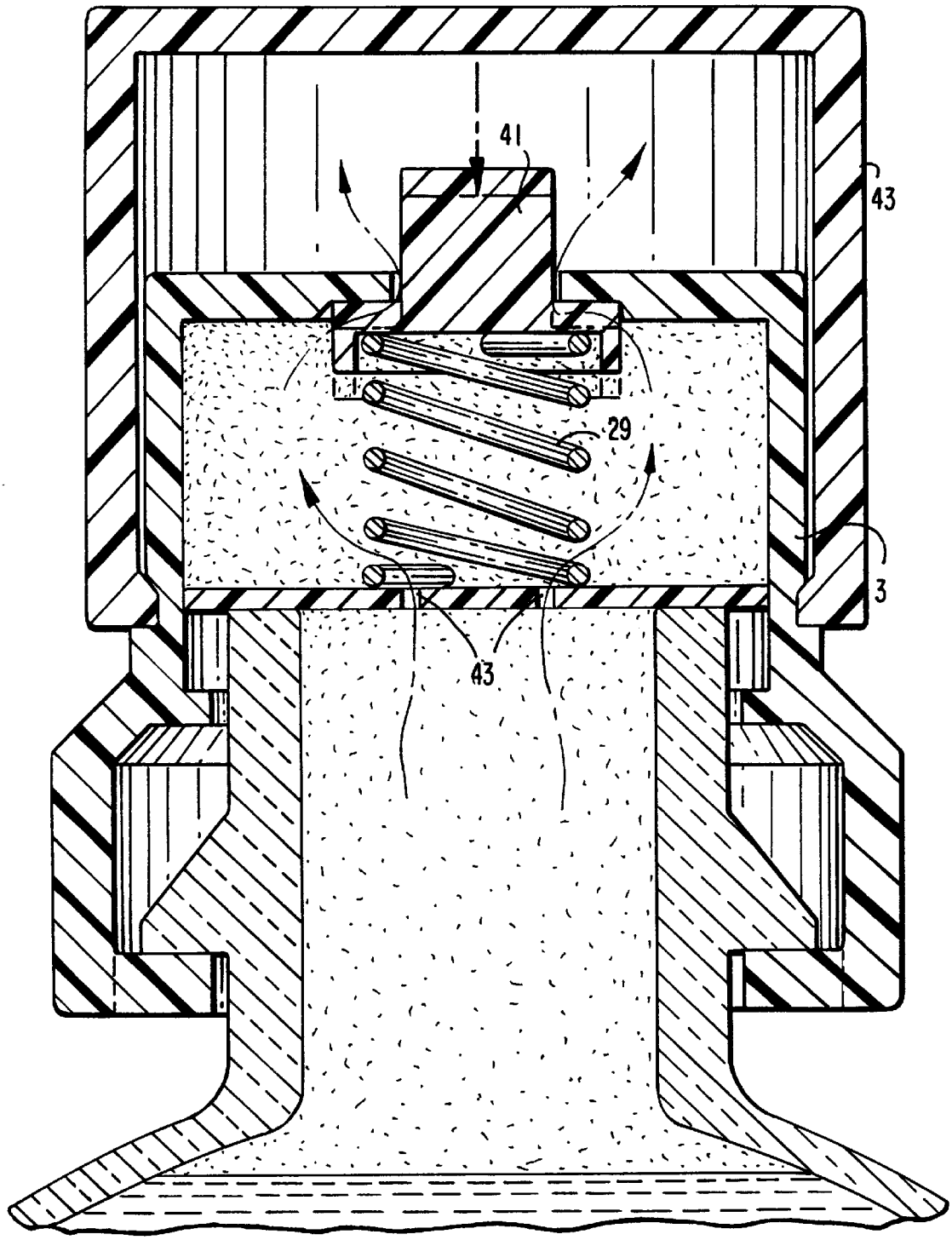

FIG. 8 shows an embodiment in which a gas is contained in a bottle. This embodiment differs from those previous by having a pressure release button 41 built into the cap. Small orifices 43 allow the slow escape of gas into an upper cavity from which the gas may be released. This release reduces force needed to compress the resilient member in order to remove the cap. A protective cap 43 may be placed over the cap 3 to protect the release button 41 from accidental compression, such as might occur during shipping.

Figure 9:
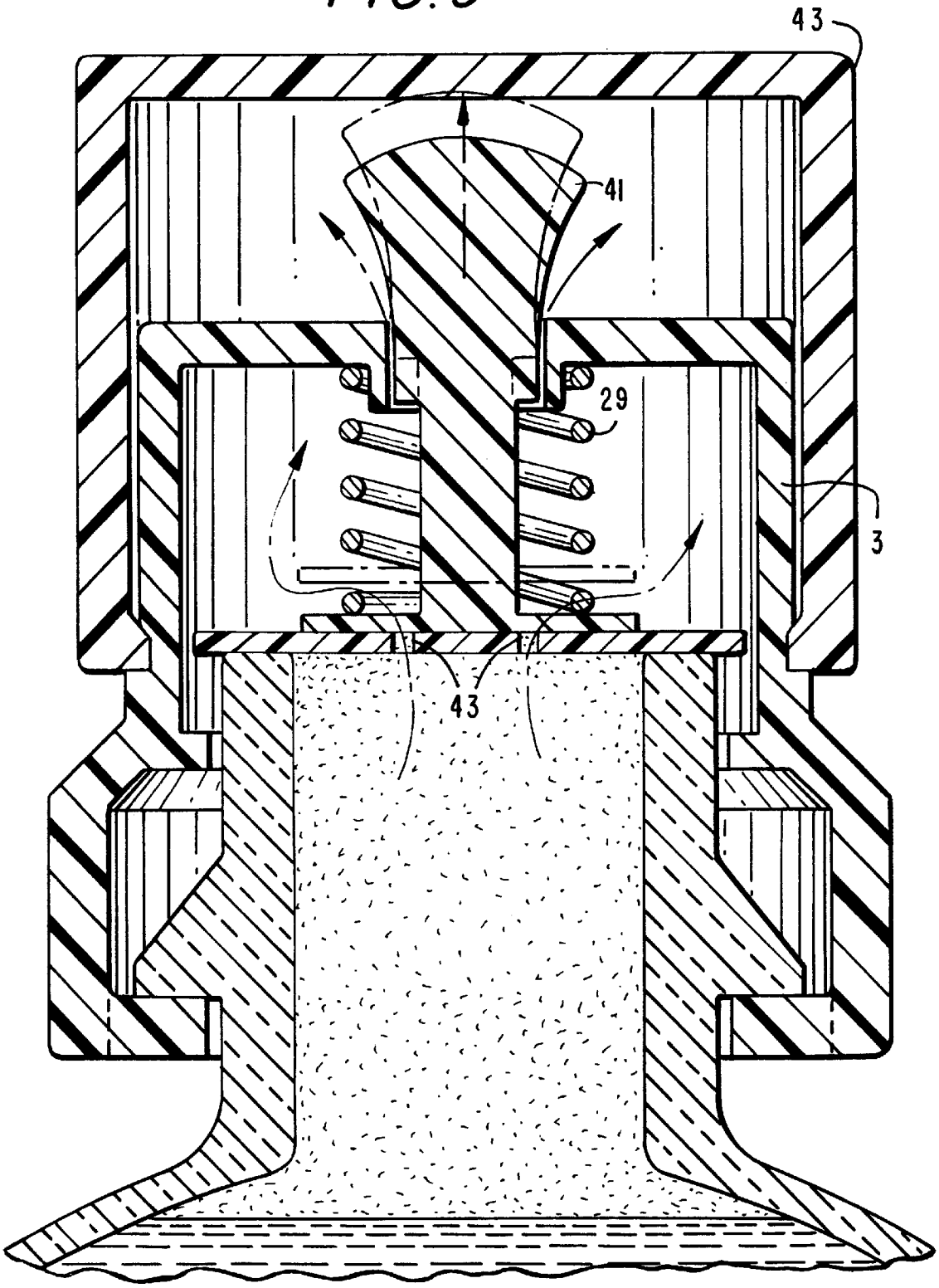

FIG. 9 shows an alternative embodiment in which the pressure is released by pulling upward on the button 41 rather than by compression. This provides further safety during transfer.

Although particular embodiments of the invention have been described, it will be apparent to persons of ordinary skill in the relevant arts that the invention may be practiced by modifications that do not depart from the substance of the invention. Accordingly the scope of protection of this patent should not be limited to the disclosed embodiments but should be determined from the following description of the invention in terms of claims.

What is claimed is:

1. A bottle having a cap,
said bottle comprising
a container having a longitudinal axis,
a neck extending upwardly from said container comprising an orifice through which contents may pass into said container, said neck comprising
a horizontal flange below said orifice, said flange having a downwardly sloping portion, said flange being longitudinally spaced from said container, P0 said cap comprising a top and, extending downward from said top,
an inner shell having
an inner dimension fitting closely with the external surface of said neck near said orifice,
a sealing surface adapted to be pressed against the top of said neck by a resilient structure and
an outer shell, said outer shell comprising a flexible portion having
an inner diameter larger than the maximum outer diameter of said sloping portion of said flange, and
prongs facing inward of said inner diameter, wherein
pressing said cap downwardly causes said prongs
to contact said sloping portion of said flange and to be displaced outwardly from the longitudinal axis, and
to be displaced inwardly to a locking position by said flexible portion when said prongs have passed downward of said flange,
said prongs preventing removal of said cap from said bottle when in said locking position
prongs being displaced outwardly when said flexible portion of said outer shell is compressed at pressure points spaced from said, said outward displacement allowing removal of said cap from said bottle.

2. The bottle having a cap of claim 1, wherein said downwardly sloping portion of said flange has an outer diameter that increases with distance from the orifice to a maximum value less than the outer diameter of said container body.

3. The bottle having a cap of claim 1, wherein said neck is narrow to accommodate liquids.

4. A bottle having a cap,
said bottle comprising
a container having a longitudinal axis,
a neck extending upwardly from said container comprising an orifice through which contents may pass into said container, said neck comprising
a horizontal flange below said orifice, said flange having a downwardly sloping portion, said flange being longitudinally spaced from said container,
said cap comprising a top and, extending downward from said top,
a shell having
a sealing surface adapted to be pressed against the top of said neck by a resilient structure and
a flexible portion having
an inner diameter larger than the maximum outer diameter of said sloping portion of said flange, and
prongs facing inward of said inner diameter, wherein
pressing said cap downwardly causes said prongs
to contact said sloping portion of said flange and to be displaced outwardly from the longitudinal axis, and
to be displaced inwardly to a locking position by said flexible portion when said prongs have passed downward of said flange,
said prongs preventing removal of said cap from said bottle when in said locking position
said prongs being displaced outwardly when said flexible portion of said outer shell is compressed at pressure points spaced from said prongs, said outward displacement allowing removal of said cap from said bottle.

5. The bottle and cap of any one of claims 1–3 and 4 wherein said cap comprises a pressure release button to relieve gas pressure within said bottle, wherein said pressure release button acts by downward pressure.

6. The bottle and cap of any one of claims 1–3 and 4 wherein said cap comprises a pressure release button to relieve gas pressure within said bottle, wherein said pressure release button acts by upward tension on said button.

7. A bottle having a cap,
said bottle comprising
a container having a longitudinal axis,
a neck extending upwardly from said container comprising an orifice through which contents may pass into said container, said neck comprising
a horizontal flange below said orifice, said flange having open slots and blind slots and being longitudinally spaced from said container, said cap comprising a top, a shell descending from said top, a sealing surface adapted to be pressed against the top of said neck by a resilient structure and said shell having an inner diameter larger than the maximum outer diameter of said flange, and prongs facing inward of said inner diameter, wherein pressing said cap downward allows said prongs to pass through said open slots and rotating and releasing said cap allows said prongs to become engaged with said blind slots in a locking position, said prongs preventing removal of said cap from said bottle when in said locking position, wherein said cap comprises a pressure release button to relieve gas pressure within said bottle, wherein said pressure release button acts by downward pressure.

8. The bottle and cap of claim 7, wherein said flange has a downwardly sloping surface.

9. The bottle and cap of claim 7, wherein said resilient structure bears against said top.

10. A bottle having a cap, said bottle comprising a container having a longitudinal axis, a neck extending upwardly from said container comprising an orifice through which contents may pass into said container, said neck comprising a horizontal flange below said orifice, said flange having open slots and blind slots and being longitudinally spaced from said container, said cap comprising a top, a shell descending from said top, a sealing surface adapted to be pressed against the top of said neck by a resilient structure and said shell having an inner diameter larger than the maximum outer diameter of said flange, and prongs facing inward of said inner diameter, wherein pressing said cap downward allows said prongs to pass through said open slots and rotating and releasing said cap allows said prongs to become engaged with said blind slots in a locking position, said prongs preventing removal of said cap from said bottle when in said locking position, wherein said cap comprises a pressure release button to relieve gas pressure within said bottle, wherein said pressure release button acts by upward tension on said button.

11. The bottle cap of claim 10, wherein said flange has a downwardly sloping surface.

12. The bottle and cap of claim 10, wherein said resilient structure bears against said top.

* * * * *